United States Patent [19]

Cha et al.

[11] 3,994,343

[45] Nov. 30, 1976

[54] PROCESS FOR IN SITU OIL SHALE RETORTING WITH OFF GAS RECYCLING

[75] Inventors: Chang Yul Cha, La Verne; Richard D. Ridley, Claremont, both of Calif.

[73] Assignee: Occidental Petroleum Corporation, Los Angeles, Calif.

[22] Filed: Mar. 4, 1974

[21] Appl. No.: 447,982

[52] U.S. Cl. ..... 166/259; 208/11 R

[51] Int. Cl.[2] ..... E21B 43/24; E21B 43/26

[58] Field of Search ..... 166/259, 256, 257, 262, 166/261; 299/2, 3; 208/11

[56] References Cited

UNITED STATES PATENTS

| | | | |
|---|---|---|---|
| 1,919,636 | 3/1930 | Karrick | 299/2 |
| 2,630,306 | 1/1952 | Evans | 166/256 |
| 2,642,943 | 6/1953 | Smith et al. | 166/261 |
| 2,780,449 | 2/1957 | Fisher et al. | 166/259 |
| 3,001,776 | 9/1961 | Van Poollen | 166/256 |
| 3,342,257 | 9/1967 | Jacobs et al. | 166/247 |
| 3,454,958 | 7/1969 | Parker | 166/256 |
| 3,548,938 | 12/1970 | Parker | 166/256 |
| 3,586,377 | 6/1971 | Ellington | 166/259 |
| 3,922,215 | 11/1975 | Linden, Jr. | 208/11 |

*Primary Examiner*—Ernest R. Purser
*Assistant Examiner*—George A. Suckfield
*Attorney, Agent, or Firm*—Christie, Parker & Hale

[57] ABSTRACT

This process is suitable for in situ retorting of oil shale particles, with retorting proceeding downwardly through a bed of broken pieces of shale. When a single bed is being retorted, air is passed downwardly after ignition until a hot zone trailing the combustion zone has built up to some predetermined thickness, for example, 20 feet having a temperature over 1000° F. Thereafter off gas from the bed is recycled downwardly without air. Reaction of the recycle gas with the heated spent shale increases the heating value of the resultant off gas. The transfer of heat without combustion increases the yield of oil. When the maximum temperature in the bed drops to a predetermined temperature above the self-ignition temperature of the shale, air is again introduced to reestablish a combustion zone and build up a hot zone. Retorting continues with alternating combustion and recycling periods through the entire bed.

When multiple beds of oil shale particles are retorted air is passed downwardly through one of the beds to maintain a combustion zone until a sufficient hot zone trailing the combustion zone has been produced. Air is then passed through a second bed of oil shale particles and at least a portion of the off gas from the second bed is recycled through the first bed for cooling the hot zone, increasing the heating value of the off gas, and retorting additional oil. Additional beds of oil shale particles can be included in series with combustion zones being intermittently established in each of the beds, alternatingly with cooling by recycled off gas.

38 Claims, 4 Drawing Figures

PROCESS FOR IN SITU OIL SHALE RETORTING WITH OFF GAS RECYCLING

BACKGROUND

There are vast untapped reserves of organic carbonaceous deposits which have not heretofore been exploited because it has not been economical to do so. The large reserves of oil bearing shale deposits throughout the world are exemplary. One of the largest of these deposits is in the Rocky Mountains of the United States. As the cost of other energy resources increases it becomes economically attractive to extract the oil from such shale.

One of the most attractive methods of extracting oil from oil shale beds is by in situ retorting. In such a technique a chamber is opened and by blasting the chamber is filled with fragmented pieces of oil shale. The top of the resultant bed of shale particles is ignited and air is passed downwardly through the bed to maintain combustion. The resultant heating decomposes the solid or semi-solid organic material (kerogen) in the shale to produce a crude oil, gas, and residual carbon that remains in the shale. Oil descends through the bed, driven by the flow of gas and by gravity. Such oil is collected from the in situ retort and processed into saleable products. U.S. Pat. No. 3,661,423, by Donald E. Garrett describes a process for in situ retorting of oil shale.

The residual carbon in the shale after the oil is retorted burns with the inlet air to supply the heat energy needed for retorting the oil from the shale. Ordinarily a portion of the oil may also burn during in situ retorting.

Suggestion has been made in U.S. Pat. No. 2,780,449 of recovering oil from shale by establishing a narrow combustion wave traveling horizontally between adjacent wells drilled into a shale formation. Oxygen content of the gas fed to the well is controlled to keep the combustion wave nearly coincident with the heat transfer wave and minimize the volume of shale at elevated temperature. A similar technique is proposed in U.S. Pat. No. 2,642,943 for secondary recovery of oil from sands. In both it is deemed desirable to keep the combustion front or combustion wave approximately coincident with the peak temperature of the heat transfer wave. The oxygen content of the driving gas is intermittently changed to permit one or the other of these waves to "catch up" if it lags behind. In U.S. Pat. No. 2,642,943, the wave is indicated to have a thickness measured in inches. No utility is suggested for the off gas from the recovery process.

When the hot gas from the combustion zone passes through the lower retorting zone it picks up combustible light gases such as hydrocarbons, hydrogen and carbon monoxide. The result is an off gas having a heating value of about 25 to 35 BTU/SCF. This off gas should be burned to avoid environmental pollution, but it is difficult to burn this gas because of its inherent low heating value. To burn such gas, additional high heating value gas or even a portion of recovered oil may be added for its additional combustion energy. This is wasteful of not only the additional combustible material but also the heating value of the off gas itself which might otherwise be used for powering operating equipment at the oil shale retorting site.

The amount of residual carbon in the spent shale resulting from retorting is theoretically sufficient to supply the necessary heat for retorting if the oil content of the shale is greater than about 10 gallons per ton. The average oil content of shale presently contemplated for economic production may average about 25 gallons per ton. It is, however, very difficult to prevent the combustion of some part of the oil produced simply by controlling the retort operating parameters since the combustion zone in the retort overlaps the retorting zone. This is due to a substantial extent to the relatively large particle sizes and the consequent limitations on the transport phenomena occurring in the bed of oil shale particles.

It is found that the combustion zone and the zone of hot spent shale in an in situ retort essentially grows continuously throughout the retorting process. That is, the volume above any arbitrary temperature, say 1000° F, grows continuously. As a result if retorting is conducted continously the retort will end up hot for most of its length. It is desirable to utilize the sensible heat contained in the long hot zone of the in situ retort to increase fuel value of the off gas so it can be used to produce power and also to enhance the oil yield.

BRIEF SUMMARY OF THE INVENTION

There is, therefore, provided in practice of this invention according to a presently preferred embodiment a method of retorting a static bed of oil shale pieces comprising the sequential steps of passing air through the bed with a combustion zone for a sufficient time to produce a hot zone of predetermined thickness trailing the combustion zone, and thereafter passing a substantially oxygen free retorting off gas through the bed in the same direction the air was passed for a sufficient time to reduce the maximum temperature of the bed to a predetermined temperature greater than the self ignition temperature of the shale, and alternately repeating the steps of passing air and off gas through the bed for transferring sensible heat through the bed and increasing the yield of oil retorted and also for increasing the heating value of the resultant off gas for burning in a work engine.

DRAWINGS

These and other features and advantages of the present invention will be appreciated as the same becomes better understood by reference to the following detailed description of a presently preferred embodiment when considered in connection with the accompanying drawings wherein.

DESCRIPTION

Figure 1:
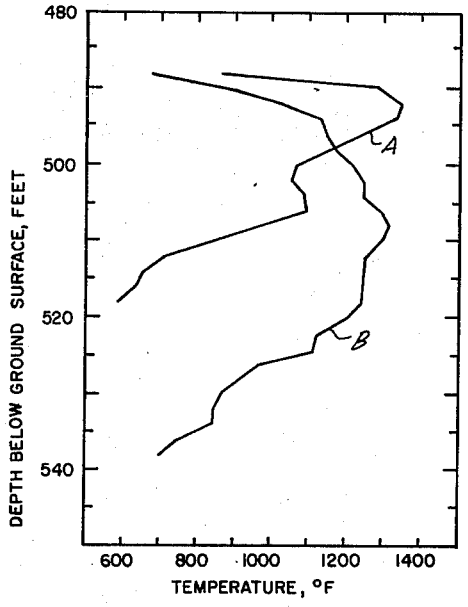
FIG. 1 is a graph of temperature in an in situ oil shale bed during retorting at two different dates about a month apart.

It has been found that in a process of in situ retorting of oil shale wherein air is passed downwardly through a combustion zone in the shale there are three generally identifiable zones which due to kinetic considerations may have appreciable overlap. In such an in situ retort the shale is ignited and a combustion or burning zone progresses slowly through the bed of shale particles as oxygen in the air reacts with residual carbon in the shale and some of the oil retorted from the shale. This combustion yields hot gases which heat the bed of oil shale particles below the combustion zone. This heating causes decomposition of the kerogen and retorting of the resultant oil and gas. Oil tends to flow from the bed of shale under the impetus of the flowing gas and also trickles down through the bed due to gravity.

The rate of heat generation in the combustion zone is greater than the cooling effect of air entering the top of the bed and the spent shale above the front of the combustion zone tends to remain hot. This zone of hot spent shale is known herein as the cooling zone although reaction of carbon in the spent shale is still occurring and some combustion may proceed in this zone. The leading zone wherein most of the combustion of residual carbon and possibly some oil is occurring is known as the burning or combustion zone, these two terms being used interchangeably herein. The zone of oil shale heated by the flowing gas in advance of the combustion zone is known herein as the retorting zone.

The in situ retort includes particles over a size range and the chemical and thermal reactions in the retort depend on transport of heat and material through the shale particles. For this reason retorting from some of the larger particles may be occurring in the same region where combustion of carbonaceous material from smaller particles is occurring. In this situation some of the retorted products may also be burned. Thus, the combustion and retorting zones are not entirely distinct regions but overlap. Similarly transport of heat and reactants may be such that the combustion zone in general passes beyond some large particles in which carbonaceous material remains. The temperature of such material remains sufficiently high that continued reaction occurs, and the cooling zone trailing the combustion zone, and the combustion zone itself also overlap to a considerable extent. It is still convenient to consider these as distinct zones for purposes of analysis and discussion.

The rate of heat generation in the combustion zone is higher than the rate of cooling due to air entering the top of the bed of oil shale particles. For this reason as time progresses and the combustion front progresses down through the bed the relatively hot cooling zone trailing the combustion zone gradually becomes thicker. Thus, in one example wherein the inlet air (with some recycled off gas) has an oxygen content of 14.5% and is passed through the bed in a volume of about 0.9 standard cubic feet per minute per square foot of bed cross section, the thickness of the hot zone at a temperature of greater than 1000° F increases at a rate of about 0.8 feet per day. This effect is confirmed in an actual in situ retorting, some results of which are illustrated in FIG. 1.

FIG. 1 illustrates the temperature profiles in an in situ bed of oil shale retorted from the top down. The vertical coordinate is the depth in the shale bed below the ground surface and the horizontal coordinate is the measured temperature. The generally higher curve A is a temperature profile measured several days after starting combustion. The somewhat lower curve B is the temperature profile measured 35 days later. It will be noted that thickness of the bed at a temperature in excess of 1000° F has increased from about 18 feet to about 34 feet. There was a substantial increase of the leading end of the hot zone and very little advance of the trailing end of the hot zone.

Retorting of oil from the kerogen in shale proceeds at about 800° F and appreciable quantities of carbonaceous materials are driven off at even lower temperatures. Shale which has been retorted and from which available hydrocarbons have been extracted has residual carbonaceous material that spontaneously burns in air at temperatures as low as about 800° F. This residual carbon in the spent shale is very active and at temperatures in excess of about 1200° F the following reactions readily occur:

$$C + CO_2 = 2CO$$
$$C + H_2O = H_2 + CO.$$

Carbon dioxide is present by reason of thermal decomposition of inorganic carbonates present in the oil shale. Water vapor may be present due to ground water in the in situ retort as well as water of crystallization of minerals and from combustion processes.

The sensible heat of the hot spent shale and the carbon present in the spent shale are utilized in practice of this invention by passing off gas from a retort through the bed instead of oxygen bearing air. This is done intermittently so that carbon in the spent shale is utilized to increase the heating value of the resultant off gas, and further, the sensible heat of the hot shale is transferred into the retorting zone for increasing the yield of oil without combustion thereof.

Figure 2A:
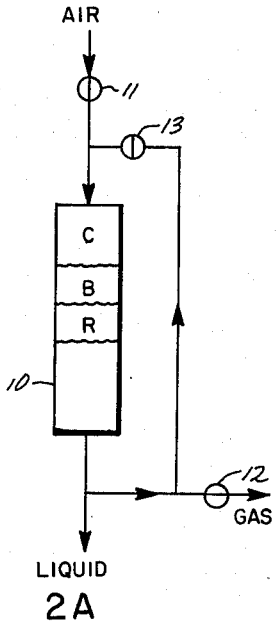
FIG. 2 is a schematic illustration of practice of this invention in a single retort wherein FIG. 2A indicates one period of operation and FIG. 2B illustrates another period of operation alternately with the first.

FIG. 2 illustrates schematically an arrangement for practicing this invention with a single in situ retort. As illustrated in FIG. 2A combustion air from a conventional blower system (not shown) is fed into the top of the retort 10 through a valve 11. The valve 11 is indicated schematically with a line therethrough indicating that the air is free to flow. In the retort 10 the combustion air passes first through a cooling zone C which has been heated to an elevated temperature by passage of the burning or combustion zone B therethrough. Combustion gases from the burning zone B pass through a retorting zone R wherein shale is heated to a sufficient temperature to extract useful hydrocarbons. At the bottom of the in situ retort 10 liquid hydrocarbons are recovered in a conventional manner as indicated by the line labelled "liquid."

The off gas from the bottom of the retort is drawn off through a valve 12 to some type of conventional burner (not shown) before it is vented to the atmosphere. Another valve 13 is provided in the off gas line so that if desired a portion of the off gas can be recycled through the retort with the combustion air. Such recycling during combustion has been previously suggested, however, the quantity of recycled gas that can be mixed with the incoming air is limited at least in part by combustion of the recycled gas. Ordinarily, the recycled gas mixed with the incoming air is no more than about 50% of the total gas flow through the retort. Some increase in oil yield results but there is no substantial benefit with respect to heating value of the off gas. The valve 13 is illustrated as if it were closed in FIG. 2A but it will be recognized that if desired some of the off gas from the retort can be recycled. It will also be apparent that a blower is needed in the off gas line to bring the pressure back up to the inlet air pressure. However, this and various control functions are well within the skill of the art and details thereof are not necessary for an understanding of the invention.

After combustion has proceeded for a sufficient time that the thickness of the hot zone trailing the burning zone has reached some predetermined thickness, operation of the retort is switched to a second mode. It will be recognized that the desired thickness is somewhat of an approximation since the combustion zone itself is not well defined and the hot zone may have different thicknesses in different portions of the bed due to particle size variations and other nonuniform conditions therein. In a preferred arrangement switching of the mode of operation is provided when the bed thickness that is at a temperature in excess of 1000° F is in the order of about 20 feet or more. Because of the relatively slow propagation of the combustion zone through a bed of oil shale, mode switching is relatively infrequent and steady reliable operation is obtained.

Figure 2B:
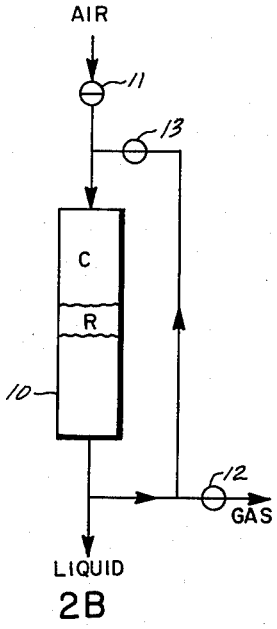

During the second mode of operation as illustrated in FIG. 2B the valve 11 is closed so that there is no inlet air to the retort. The valve 13 is opened so that off gas from the bottom of the retort is recycled through the bed of oil shale particles in the same direction as the air was passed during the combustion mode. Since the off gas is substantially free of oxygen there is no longer a combustion or burning zone in the retort. The recycling off gas first passes through a cooling zone C which contains residual heat from the prior combustion and also residual unburned carbon. Reaction of portions of the off gas with the unburned carbon occurs in the warmer portions of the cooling zone. The heated gas then passes through a retorting zone R where the sensible heat elevates the temperature of the oil shale and extracts hydrocarbon materials therefrom. Since the gas is free of oxygen there is no combustion of the freed hydrocarbons and the yield of oil is enhanced.

During the recycling mode of operation there is an increase in total gas volume in part due to reaction of water vapor and carbon to form hydrogen and carbon monoxide, in part due to reaction of carbon and carbon dioxide to carbon monoxide, in part due to thermal decomposition of inorganic carbonates, and in part due to retorting of light hydrocarbon gases in the retorting zone. A portion of the off gas is, therefore, removed by way of the off gas valve 12 for combustion at the retorting site. In a typical embodiment about one-third of the gas may be bled off and burned and two-thirds recycled.

In one run wherein there was substantial recycling of off gas through a single retort without addition of combustion air the ratios of hydrogen to methane and carbon monoxide to methane were measured in the off gas.

In a typical analysis the ratio of hydrogen to methane was about 3.5, and the ratio of carbon monoxide to methane was about 4.0. These ratios from Fischer Assay analysis oil shale are about 2.2 and 0.2, respectively. Methane is adopted as a standard in such ratios since it can be produced only from retorting of the oil shale. The high proportions of hydrogen and carbon monoxide establish the occurrence of the above-identified reactions with carbon in the spent shale.

The reactions of the gas with residual carbon during recycling and the absence of oxidation of the light hydrocarbon gases increases the heating value of the off gas from the bottom of the retort. It is not unusual for the resultant off gas to have twice the heating value of the gas produced during the combustion mode of the operation. Such gas has a sufficient heating value that it is preferably burned in a conventional gas turbine or other suitable work engine which provides shaft horsepower for air and gas compressors for use in the retorting operation or for other power requirements at the retorting site.

The recycling mode of operation is continued until the maximum temperature in the bed of shale being retorted has dropped to some predetermined temperature that is above the self ignition temperature of the spent shale. Conveniently, for example, recycling continues until the maximum temperature in the bed drops to about 1000° F. The self ignition temperature of carbon in spent shale is about 800° F and the somewhat higher temperature provides an adequate margin of safety to assure re-ignition during the next step of the process.

Temperature in the bed can be measured by a column of thermocouples in a bore hole through the bed of shale or can be estimated from known operating parameters of such in situ oil shale beds. It is also found that as the temperature drops the reactions between the recycled gas and residual carbon, particularly the carbon dioxide to carbon monoxide reaction, change and an adequate estimate of temperature can be obtained by monitoring the off gas composition.

When the zone of hot rock in excess of about 1000° F is about 20 feet thick or more substantial portions are at sufficiently high temperature that the carbon monoxide and hydrogen producing reactions are occurring. Switching from the burning mode of retorting with air passing through the bed is then feasible. As the retorting off gas flows down through the hot zone combustible gases are formed and the heating value of the resultant off gas remains high. If switching to the recycling mode occurs with a bed of less than about 20 feet over 1000° F, the temperature may fall rapidly enough that the heating value of the off gas decreases in a relatively short time.

A good way of deciding when to switch back to the burning mode is to monitor the off gas during recycling. When the heating value of the off gas drops below about 100 BTU/SCF it is difficult to burn and additional fuel may be needed to make it useful in a gas turbine or similar fuel engine for producing shaft horsepower. It is, therefore, preferred to shift from the recycling mode to the burning mode when the heating value of the off gas drops below about 100 BTU/SCF.

The heating value of the off gas from the retort is significantly enhanced by periodically recycling off gas in the absence of inlet combustion air. Thus, for example, in one run wherein 62.8% of the off gas was recycled through the retort and 37.2% was burned, the initial heating value of the gas without such recycling was about 63 BTU/SCF. After three hours of recycling the heating value had more than doubled to about 137 BTU per SCF.

Analysis of the gas composition showed increases in hydrogen and carbon monoxide indicating that the above identified reactions with residual carbon were, in fact, occurring. Carbon dioxide content increased substantially, due to thermal decomposition of carbonates. Nitrogen content was greatly decreased, due to the absence of replenishment air and continual bleed of a portion of the off gas. Further the concentration of hydrocarbon gases increased significantly indicating that continued retorting was present. The following table shows the gas compositions at 15 minutes and at three hours after the commencement of recycling:

| | Composition of Off Gas | |
|---|---|---|
| Constituent | 15 min. recycling | 3 hour recycling |
| $H_2$ | 6.4% | 11.44 |

-continued

| Constituent | Composition of Off Gas 15 min. recycling | 3 hour recycling |
|---|---|---|
| $N_2$ | 63.9 (by diff.) | 5.77 |
| CO | 6.4 | 14.7 |
| $CH_4$ | 1.46 | 3.08 |
| $CO_2$ | 21.24 | 63.35 |
| Ethane | 0.19 | 0.34 |
| $H_2S$ | 0.07 | 0.36 |
| Propane* | 0.35 | 0.93 |

*Including hydrocarbon gases high than $C_3$

Figure 3:
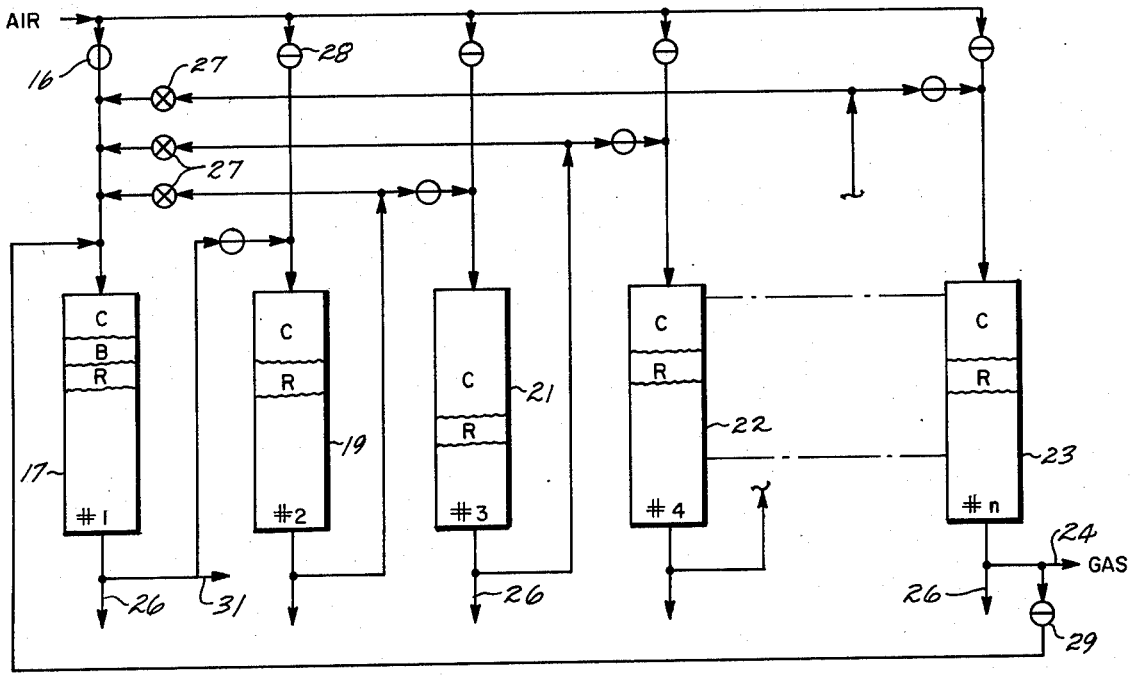
FIG. 3 illustrates schematically application of principles of this invention to multiple retorts.

FIG. 3 illustrates schematically application of principles of this invention to multiple in situ retorts. As illustrated in this embodiment compressed air is fed through a valve 16 into the top of an in situ retort 17 containing a bed of oil shale particles. The shale is ignited so that a burning zone B is established in the retort. A cooling zone C trails the zone of most active burning and hot gas flowing through the retort also establishes a retorting zone R in advance of the combustion zone B. It will be recognized that the active retorting in the retort 17 is similar to that in the retort hereinabove described and illustrated in FIG. 2A.

Off gas from this No. 1 retort 17 is carried by a line to the top of a No. 2 in situ retort 19. This off gas passes down through the No. 2 retort in the same manner as the recycled gas through the retort hereinabove described and illustrated in FIG. 2B. Since the off gas is substantially free of oxygen, there is no combustion zone in the No. 2 retort. The off gas from the No. 2 retort is passed to the top of a No. 3 in situ retort 21 and passes down through it in a similar manner. Off gas from the No. 3 retort is passed down through a No. 4 retort 22. This continues for any arbitrary number of retorts with the off gas from each preceding retort being passed down through a successive retort. Off gas from the No. n retort 23 is taken off by a line 24 for combustion in a gas turbine or the like to produce shaft horsepower. It will be recognized that the number n of retorts in series may actually be four or less and may be as few as two. The time in the burning mode may be appreciably shorter than that in the recycling mode for any particular retort and several may, therefore, be operated in series.

The several retorts after the first retort 17 have previously been ignited and a hot cooling zone C established in each. As the recycled off gas passes down through the respective cooling zone C in each retort, a retorting zone R is maintained. Liquid hydrocarbons are extracted from each of the retorts by way of a line 26 in a conventional manner.

A series of valves 27 are provided in the various off gas lines so that a portion of the off gas from any or several of the retorts can be cycled through the No. 1 retort with the combustion air. It will be recognized that if desired a portion of the off gas from any of the retorts can be withdrawn and burned to minimize the build-up of gas volume in successive retorts.

After a period of operation in which a substantial thickness of hot zone is built up in the No. 1 retort and the hot zone decreased in successive retorts, the air valve 16 to the No. 1 retort is closed and an air valve 28 to the No. 2 retort opened. When this is done off gas from the No. n retort 23 is passed down through the No. 1 retort by way of a valve 29. Off gas from the No. 1 retort is drawn off by a line 31 for combustion in the gas turbine (not shown). This changed mode of operation reestablishes a combustion zone in the No. 2 retort and the No. 1 retort goes into a mode wherein there are only a cooling zone C and a retorting zone R. The effect is as if the No. 2 retort became No. 1 and the No. 1 retort became No. n.

This periodic changing of the mode of operation of the several retorts continues successively through the several retorts in series. Thus, each retort is intermittently in a combustion mode of operation wherein air is supplied at the top and alternately is in a recycling mode wherein substantially oxygen free off gas from another retort is passed therethrough in the same direction as the air.

By having multiple retorts in series, the retorting zones can be at different levels in the various beds and new retorts can be put on stream and others taken off as the shale becomes depleted while maintaining a reasonably steady high fuel value in the final off gas. This enables the several retorts to be operated on what is effectively a continuous basis as compared with the batch basis when a single retort is intermittently alternated between one mode and the other. Each retort in the series is intermittently changed from one mode of operation to the other in the same manner as the single retort hereinabove described and illustrated in FIG. 2. The yield of oil from the several retorts is enhanced and in particular the heating value of the off gas is increased to economically advantageous levels. The fuel value of the off gas from intermediate retorts may be lower than optimum for use in a gas turbine and may be mixed with final off gas for recovering maximum energy. Switching from the recycling mode to the burning mode can be somewhat delayed in some of the intermediate retorts as compared with operation with recycling in a single retort.

Although limited embodiments of process for in situ retorting of oil shale have been described and illustrated herein many modifications and variations will be apparent to one skilled in the art. It will be apparent that the same principles can be used in retorting oil shale removed from the mine and stacked in a retort although the principal applicability and advantages are in vertical in situ retorting. Many other modifications and variations will be apparent to one skilled in the art and it is therefore to be understood that within the scope of the appended claims the invention may be practiced otherwise than as specifically described.

What is claimed is:

1. A method of retorting a bed of oil shale particles and increasing the heating value of retorting off gas withdrawn from a bed of oil shale particles comprising the steps of:

establishing a combustion zone in the bed of oil shale particles;

passing an oxygen-bearing gas, during a combustion mode of operation, through the bed and into the combustion zone for a time sufficient to produce a hot zone in the bed having a high temperature above the self-ignition temperature of carbonaceous material in the shale, for retorting oil shale and producing shale oil and retorting off gas;

withdrawing shale oil and retorting off gas from the bed during the combustion mode of operation;

terminating the passage of oxygen-bearing gas through the bed;

producing retorting off gas having a higher heating value than the retorting off gas produced during the combustion mode of operation by passing a substantially oxygen-free retorting off gas, during a gas-enriching mode of operation, through the bed and hot zone for a time sufficient to reduce the high temperature of the hot zone to a lower temperature which is above the self-ignition temperature of carbonaceous material in the shale, thereby retorting oil shale and producing shale oil; and withdrawing shale oil and retorting off gas from the bed during the gas-enriching mode of operation.

2. A method as defined in claim 1 wherein, during a gas-enriching mode of operation, retorting off gas is withdrawn from the bed and at least a portion of the withdrawn off gas is recycled through the bed and hot zone.

3. A method of retorting oil shale as defined in claim 1 wherein the producing step comprises:

establishing a combustion zone in a second bed of oil shale particles;

passing an oxygen bearing gas through the second bed of oil shale particles and into the combustion zone in the second bed; and withdrawing off gas from the second bed and adding at least a portion of the off gas from the second bed to the first bed.

4. A method of retorting oil shale as defined in claim 3 further comprising:

passing off gas from the first bed through the second bed concurrently with the first passing step.

5. A method of retorting oil shale as defined in claim 3 wherein the producing step further comprises:

passing withdrawn off gas from the second bed through a third bed of oil shale particles having a hot zone therein; and passing at least a portion of the resultant off gas from the third bed through the first bed.

6. A method as defined in claim 1 wherein the combustion mode of operation is conducted until the hot zone has a thickness of about 20 feet at a temperature in excess of about 1000° F.

7. A method as defined in claim 6 wherein the gas enriching mode of operation is conducted until the maximum temperature in the bed decreases to about 1000° F.

8. A method as defined in claim 1 wherein at least a portion of the retorting off gas produced during the gas enriching mode of operation is burned in a work engine for producing usable power.

9. A method as defined in claim 1 wherein the combustion and enriching modes of operation are alternately repeated.

10. The method ad defined in claim 1, further comprising:

terminating the passage of substantially oxygen-free retorting off gas through the bed and hot zone during a gas enriching mode of operation when the heating value of the retorting off gas withdrawn therefrom decreases to less than about 100 BTU/SCF: and again passing oxygen-bearing gas through the bed.

11. A method as defined in claim 1 further comprising:

terminating the passage of substantially oxygen-free retorting off gas through the bed and hot zone during a gas enriching mode of operation when the retorting off gas withdrawn therefrom decreases to less than about the minimum value required for burning such retorting off gas in a work engine; and again passing oxygen-bearing gas through the bed.

12. A process for increasing the heating value of off gas during in situ retorting of a bed of oil shale particles containing a portion of unretorted oil shale and a portion of spent shale with a hot zone therebetween comprising the steps of:

supplying air to the bed from the portion having spent shale towards the portion having unretorted oil shale for sustaining combustion in the hot zone;

intermittently stopping air supply to the bed of oil shale after the hot zone is established and recycling off gas from the bed back through the bed in the same direction as air supply, for reacting non-combustible gas in the off gas with carbon in the spent shale to produce combustible gas and advance sensible heat in the bed in the direction of gas flow; and continuing recycle of retorting off gas until maximum temperature in the oil shale decreases to a value below which reaction of off gas with carbon does not proceed.

13. A method as defined in claim 12 further comprising intermittently resupplying air to the retort when the maximum temperature thereof is above the self ignition temperature of spent oil shale for reestablishing a combustion zone therein.

14. A process for retorting a bed of oil shale particles in an in situ oil shale retort and increasing the heating value of retorting off gas comprising the steps of:

establishing a combustion zone in a first bed of oil shale particles;

passing air, during a combustion mode of operation of the first bed, downwardly through the first bed of oil shale particles and combustion zone in the first bed for a time sufficient to produce a hot zone in the bed having a high temperature above the self-ignition temperature of carbonaceous material in the shale, for retorting oil shale and producing shale oil and retorting off gas;

withdrawing shale oil and retorting off gas from the first bed during the combustion mode of operation of the first bed;

establishing a combustion zone in a second bed of oil shale particles;

passing air, during a combustion mode of operation of the second bed downwardly through the second bed of oil shale particles and combustion zone in the second bed for retorting oil shale and producing shale oil and retorting off gas;

withdrawing shale oil and retorting off gas from the second bed during the combustion mode of operation of the second bed;

terminating the passage of air through the first bed;

passing at least a portion of the retorting off gas withdrawn from the second bed, downwardly through the first bed during a gas enriching mode of operation of the first bed for retorting oil shale and producing shale oil and a retorting off gas having a higher heating value than the retorting off gas withdrawn from the second bed during a combustion mode of operation of the second bed; and withdrawing shale oil and retorting off gas from the first bed during the gas-enriching mode of operation of the first bed.

15. A process as defined in claim 14, further comprising the step of burning at least a portion of the retorting off gas withdrawn from the first bed during a gas enriching mode of operation of the first bed in a gas turbine.

16. A method as defined in claim 14 further comprising the steps of:

establishing a combustion zone in a third bed of oil shale particles;

passing air through the third bed and into the combustion zone in the third bed during a combustion mode of operation of the third bed for a time sufficient to produce a hot zone in the third bed having a high temperature above the self-ignition temperature of oil shale, for retorting oil shale and producing shale oil and retorting off gas;

withdrawing shale oil and retorting off gas from the third bed during the combustion mode of operation thereof;

terminating the passage of air through the third bed;

passing a substantially oxygen-free retorting off gas withdrawn from the second bed, through the third bed and hot zone in the third bed during a gas-enriching mode of operation of the third bed for retorting oil shale and producing shale oil and retorting off gas having a higher heating value than the retorting off gas produced during the combustion mode of operation of the second bed;

withdrawing shale oil and retorting off gas from the third bed during the gas enriching mode of operation of the third bed; and wherein the substantially oxygen-free retorting off gas passed through the first bed and hot zone in the first bed during a gas enriching mode of operation thereof comprises at least a portion of the retorting off gas withdrawn from the third bed during a gas enriching mode of operation of the third bed.

17. A method of retorting a bed of oil shale particles in an in situ oil shale retort and increasing the heating value of retorting off gas comprising the steps of:

igniting carbonaceous material in the bed of oil shale particles and establishing a combustion zone in the bed;

passing air, during a combustion mode of operation, downwardly through the bed and into the combustion zone for a time sufficient to produce a hot zone in the bed having a high temperature above the self-ignition temperature of carbonaceous material in the shale, for retorting oil shale and producing shale oil and retorting off gas;

withdrawing shale oil and retorting off gas from the bed during the combustion mode of operation;

terminating the passage of air through the bed;

producing retorting off gas having a higher heating value than the retorting off gas produced during the combustion mode of operation by passing substantially oxygen-free retorting off gas, during a gas enriching mode of operation, downwardly through the bed and hot zone for retorting oil shale and producing shale oil; and withdrawing shale oil and retorting off gas from the bed during the gas enriching mode of operation.

18. A method as defined in claim 17 further comprising:

terminating the passage of substantially oxygen-free retorting off gas through the bed and hot zone during a gas-enriching mode of operation when temperature in the hot zone is decreased to a temperature which is lower than said high temperature and which is higher than the self-ignition temperature of oil shale; and again passing air downwardly through the bed.

19. A method as defined in claim 17 further comprising:

terminating the passage of substantially oxygen-free retorting off gas through the bed and hot zone during a gas enriching mode of operation when the heating value of the retorting off gas produced during the gas enriching mode of operation decreases to less than about 100 BTU/SCF: and again passing air downwardly through the bed.

20. A method as defined in claim 17 further comprising:

terminating the passage of substantially oxygen-free retorting off gas through the bed and hot zone during a gas enriching mode of operation when the heating value of the retorting off gas withdrawn therefrom decreases to about the minimum value required for burning such retorting off gas in a work engine; and again passing air downwardly through the bed and combustion zone.

21. A method as defined in claim 17 comprising the step of recycling at least a portion of the withdrawn retorting off gas through the bed during the gas enriching mode of operation.

22. A method as defined in claim 17 further comprising the steps of:

establishing a combustion zone in a second bed of oil shale particles;

passing air downwardly through the second bed and combustion zone for retorting oil shale and producing shale oil and retorting off gas;

withdrawing retorting off gas from the second bed; and wherein the substantially oxygen-free retorting off gas passed through the first mentioned bed and hot zone of the first mentioned bed during a gas enriching mode of operation comprises at least a portion of the retorting off gas withdrawn from the second bed.

23. A process for retorting oil shale in situ and producing an off gas having useful heating value comprising the steps of:

passing air through a first bed of oil shale particles having a progressing burning zone for a sufficient time to produce a hot zone having a predetermined thickness; and thereafter passing air through a second bed of oil shale particles having a progressing burning zone and passing at least a portion of the off gas from the second bed through the first bed for reaction with carbon in the hot zone and transferring heat from the hot zone without substantial combustion in the first bed.

24. A process for retorting oil shale in situ as defined in claim 23 further comprising the step of passing at least a portion of the off gas from the second bed through a third bed having a hot zone therein before passing the off gas through the first bed.

25. A method of retorting a static bed of oil shale pieces comprising the steps of:

igniting one end of the bed of oil shale particles;

introducing air into the bed from the ignited end for supporting combustion of carbonaceous material in the shale in a burning zone, driving the burning zone through the bed, and retorting oil from the shale in advance of the burning zone, and as a result establishing a hot zone of spent shale in the bed at a temperature above the retorting temperature of shale oil; and thereafter passing substantially oxygen free retorting off gas through the bed until the fuel value of the resultant off gas is less than about 100 BTU/SCF: and returning to the introducing step.

26. A method of retorting oil shale as defined in claim 25 comprising the steps of:

withdrawing off gas from the other end of the bed during the second passing step; and conducting at least a portion of this off gas to the one end of the bed for recycling.

27. A method of retorting oil shale as defined in claim 25 further comprising:

introducing air into one end of a second bed of oil shale particles having a burning zone therein concurrently with the second mentioned passing step;

withdrawing off gas from the other end of the second bed; and conducting at least a portion of the off gas from the second bed to the first bed for the second passing step.

28. A method of advancing a retorting zone through an oil shale retort containing fragmented oil shale particles and having a retorting zone, a hot zone and, during a combustion mode of operation, a combustion zone, wherein the retorting zone is on the advancing side of the hot zone in the oil shale retort, and heat is transferred from the hot zone to the retorting zone by moving gas through the oil shale retort so that the gas moves from the hot zone, wherein gas is heated, to the retorting zone wherein the heated gas supplies heat for converting kerogen in the oil shale into shale oil, gas and residual carbon, which comprises the steps of:

passing oxygen-bearing gas, during a combustion mode of operation, through the oil shale retort so that oxygen in the oxygen-bearing gas reacts with heated carbonaceous material in the oil shale retort for establishing a combustion zone and maintaining same during the combustion mode of operation for building up the hot zone, retorting oil shale and producing shale oil and retorting off gas;

withdrawing shale oil and retorting off gas from the oil shale retort during the combustion mode of operation;

discontinuing the passage of oxygen-bearing gas through the retort;

producing a retorting off gas having a higher heating value than the retorting off gas produced during the combustion mode of operation by passing retorting off gas, during a gas-enriching mode of operation, through the hot zone and retorting zone for retorting oil shale and producing shale oil; and withdrawing shale oil and retorting off gas from the oil shale retort during the gas-enriching mode of operation.

29. The method as recited in claim 28 wherein said oxygen-bearing gas is a mixture of greater than about 50% by volume air and less than about 50% by volume retorting off gas.

30. The method as recited in claim 28 wherein the hot zone is the volume of oil shale in the oil shale retort having a temperature of greater than about 1000° F.

31. The method as recited in claim 30 wherein the thickness of the hot zone is greater than about 20 feet when the combustion mode of operation is terminated.

32. The method as recited in claim 30 wherein said retorting off gas passed through the hot zone during a gas enriching mode of operation is substantially oxygen free.

33. The method as recited in claim 32 wherein the passing of retorting off gas is terminated when the maximum temperature of the hot zone is decreased to a temperature no less then about 1000° F.

34. A method as defined in claim 28 further comprising:

terminating the passage of substantially oxygen-free retorting off gas through the bed and hot zone during a gas enriching mode of operation when the heating value of the retorting off gas produced during the gas enriching mode of operation decreases to less than about 100 BTU/SCF; and again passing oxygen-bearing gas through the bed.

35. A method as defined in claim 28 further comprising:

terminating the passage of substantially oxygen-free retorting off gas through the bed and hot zone during a gas enriching mode of operation when the heating value of the retorting off gas withdrawn therefrom decreases to about the minimum value required for burning such retorting off gas in a work engine; and again passing oxygen-bearing gas through the bed and combustion zone.

36. A method of retorting a series of beds of oil shale particles in in situ oil shale retorts and increasing the heating value of retorting off gas comprising the steps of:

establishing a combustion zone in each of the beds in the series;

passing oxygen-bearing gas, during a combustion mode of operation, downwardly through each respective bed in the series and into its respective combustion zone for producing a hot zone, for retorting oil shale, and producing shale oil and retorting off gas;

withdrawing shale oil and retorting off gas from each bed during the combustion mode of operation thereof;

terminating the passage of oxygen-bearing gas through at least one bed and, during a gas enriching mode of operation, passing retorting off gas withdrawn from another bed in the series downwardly through said one bed and its respective hot zone for retorting oil shale and producing shale oil and enriched retorting off gas having a higher heating value than the retorting off gas produced in a bed in the series during a combustion mode of operation;

withdrawing shale oil and enriched retorting off gas from said one bed during the gas enriching mode of operation; and alternately, maintaining combustion and enriching modes of operation in the beds in the series until the beds in the series are retorted.

37. A method of claim 36 wherein the enriched retorting off gas from said one bed is passed through a bed in the series of beds during a gas-enriching mode of operation thereof.

38. A method as defined in claim 36 wherein the enriched retorting off gas is passed through successive beds of the series of beds during gas enriching modes of operation until the heating value of the retorting off gas is increased to above the minimum heating value required for burning the retorting off gas.

* * * * *